US009153158B2

(12) United States Patent
Kim et al.

(10) Patent No.: US 9,153,158 B2
(45) Date of Patent: Oct. 6, 2015

(54) LIGHT EMITTING DISPLAY DEVICE CAPABLE OF MINIMIZING A CURRENT DRIVING CAPABILITY DEVIATION AMONG DRIVING SWITCHING ELEMENTS

(71) Applicant: LG Display Co., Ltd., Seoul (KR)

(72) Inventors: Ji-Hun Kim, Paju-si (KR); Jong-Sik Shim, Seoul (KR); Min-Kyu Chang, Seoul (KR)

(73) Assignee: LG Display Co., Ltd., Seoul (KR)

( * ) Notice: Subject to any disclaimer, the term of this patent is extended or adjusted under 35 U.S.C. 154(b) by 343 days.

(21) Appl. No.: 13/726,244

(22) Filed: Dec. 24, 2012

(65) Prior Publication Data

US 2013/0162620 A1 Jun. 27, 2013

(30) Foreign Application Priority Data

Dec. 26, 2011 (KR) ..... 10-2011-0142422

(51) Int. Cl.
*G09G 3/20* (2006.01)
*G09G 3/32* (2006.01)

(52) U.S. Cl.
CPC ..... *G09G 3/20* (2013.01); *G09G 3/3233* (2013.01); *G09G 2300/0819* (2013.01); *G09G 2300/0852* (2013.01); *G09G 2300/0861* (2013.01)

(58) Field of Classification Search
CPC ..... G09G 3/20; G09G 3/3233; G09G 2300/0852; G09G 2300/0861
USPC ..... 345/212
See application file for complete search history.

(56) References Cited

U.S. PATENT DOCUMENTS

| | | | | |
|---|---|---|---|---|
| 2006/0044235 | A1 | 3/2006 | Lee et al. | |
| 2009/0201228 | A1* | 8/2009 | Kim et al. | 345/60 |
| 2010/0020065 | A1* | 1/2010 | Takasugi | 345/214 |
| 2011/0279433 | A1* | 11/2011 | Ryu | 345/211 |
| 2012/0038605 | A1* | 2/2012 | Han | 345/211 |

FOREIGN PATENT DOCUMENTS

| | | | |
|---|---|---|---|
| CN | 101866614 | A | 10/2010 |
| CN | 101943974 | A | 1/2011 |
| KR | 10-2010-0035424 | A | 4/2010 |
| KR | 10-2010-0110060 | A | 10/2010 |

OTHER PUBLICATIONS

State Intellectual Property Office of the People's Republic of China, First Office Action, Chinese Patent Application No. 201210568114.7, Aug. 28, 2014, eight pages.

* cited by examiner

*Primary Examiner* — Ryan A Lubit
*Assistant Examiner* — Yaron Cohen
(74) *Attorney, Agent, or Firm* — Fenwick & West LLP

(57) ABSTRACT

Disclosed is a light emitting display device capable of minimizing a current driving capability deviation among driving switching elements. The light emitting display device includes pixels each including a first TFT for supplying data voltage to a first node in response to a scan signal, a second TFT for forming a current path between first and second nodes in response to an emission control signal, a driving TFT for forming a current path between a first driving voltage supply line and a third node in accordance with a voltage level of the second node, a third TFT for supplying a reference voltage to a fourth node in response to a sensing signal, a fourth TFT for supplying an initialization voltage to the third node in response to an initialization signal, and a fifth TFT for supplying the reference voltage to the second node in response to the initialization signal.

12 Claims, 7 Drawing Sheets

LIGHT EMITTING DISPLAY DEVICE CAPABLE OF MINIMIZING A CURRENT DRIVING CAPABILITY DEVIATION AMONG DRIVING SWITCHING ELEMENTS

CROSS-REFERENCE TO RELATED APPLICATIONS

This application claims the benefit of Korean Patent Application No. 10-2011-0142422, filed on Dec. 26, 2011, which is hereby incorporated by reference as if fully set forth herein.

BACKGROUND OF THE INVENTION

1. Field of the Invention

The present invention relates to a light emitting display device capable of minimizing a current driving capability deviation among driving switching elements of pixels, thereby achieving enhancement in picture quality.

2. Discussion of the Related Art

Each pixel of a light emitting display device includes a driving switching element, which is generally a constant current element. The current driving capability of such a driving switching element is greatly influenced by the turn-on threshold voltage of the driving switching element.

To this end, a technology for reducing a current driving capability deviation among driving switching elements of pixels is required.

SUMMARY OF THE INVENTION

Accordingly, the present invention is directed to a light emitting display device that substantially obviates one or more problems due to limitations and disadvantages of the related art.

An object of the present invention is to provide a light emitting display device capable of minimizing a current driving capability deviation among driving switching elements of pixels, thereby achieving enhancement in picture quality.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a light emitting display device includes a plurality of pixels arranged in the form of a matrix, to display an image, wherein each of the pixels includes a first switching element for supplying, to a first node, a data voltage supplied from a data line in response to a scan signal supplied from a scan line, a second switching element for forming a current path between the first node and a second node in response to an emission control signal supplied from an emission control line, a driving switching element for forming a current path between a supply line for a first driving voltage and a third node in accordance with a voltage level of the second node, a third switching element for supplying a reference voltage to a fourth node in response to a sensing signal supplied from a sensing line, a fourth switching element for supplying an initialization voltage supplied from an initialization line to the third node in response to an initialization control signal supplied from an initialization control line, a fifth switching element for supplying the reference voltage to the second node in response to the initialization control signal, a first capacitor connected between the first node and the third node, a second capacitor connected between the second node and the fourth node, a third capacitor connected between the first node and the fourth node, and an organic light emitting diode connected between the third node and a supply line for a second driving voltage.

The initialization voltage may be lower than the reference voltage. The reference voltage may be lower than the second driving voltage. The second driving voltage may be lower than the first driving voltage.

Each of the pixels may be driven in a separate manner in a first period in which the initialization signal, the sensing signal, and the emission control signal are output at a gate-on voltage level, a second period in which the sensing signal is output at the gate-on voltage level, a third period in which the sensing signal and the scan signal are output at the gate-on voltage level, and a fourth period in which the emission control signal is output at the gate-on voltage level.

Each of the pixels may further include a fourth capacitor connected between the second node and the third node.

Each of the first to fifth switching elements and the driving switching element may be a P-type or N-type switching element.

In another aspect of the present invention, a light emitting display device includes a plurality of pixels arranged in the form of a matrix, to display an image, wherein each of the pixels includes a first switching element for supplying, to a first node, a data voltage supplied from a data line in response to a scan signal supplied from a scan line, a second switching element for forming a current path between the first node and a second node in response to an emission control signal supplied from an emission control line, a driving switching element for forming a current path between a supply line for a first driving voltage and a third node in accordance with a voltage level of the second node, a third switching element for supplying a reference voltage to a fourth node in response to a sensing signal supplied from a sensing line, a fourth switching element for supplying an initialization voltage supplied from an initialization line to the third node in response to an initialization control signal supplied from an initialization control line, a fifth switching element for supplying the reference voltage to the second node in response to the initialization control signal, a sixth switching element for forming a current path between the first node and the fourth node in response to the emission control signal, a first capacitor connected between the first node and the third node, a second capacitor connected between the second node and the fourth node, and an organic light emitting diode connected between the third node and a supply line for a second driving voltage.

The initialization voltage may be lower than the reference voltage. The reference voltage may be lower than the second driving voltage. The second driving voltage may be lower than the first driving voltage.

Each of the pixels may be driven in a separate manner in a first period in which the initialization signal, the sensing signal, and the emission control signal are output at a gate-on voltage level, a second period in which the sensing signal is output at the gate-on voltage level, a third period in which the sensing signal and the scan signal are output at the gate-on voltage level, and a fourth period in which the emission control signal is output at the gate-on voltage level.

Each of the first to sixth switching elements and the driving switching element may be a P-type or N-type switching element.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Thin film transistors (TFTs), which will be described in conjunction with embodiments, may be of a P type or an N type. However, the following description will be given in conjunction with the case in which the TFTs have an N-type conductivity. In the following embodiments, accordingly, a gate-on voltage is a gate-high voltage VGH, and a gate-off voltage is a gate-low voltage VGL.

Figure 1:
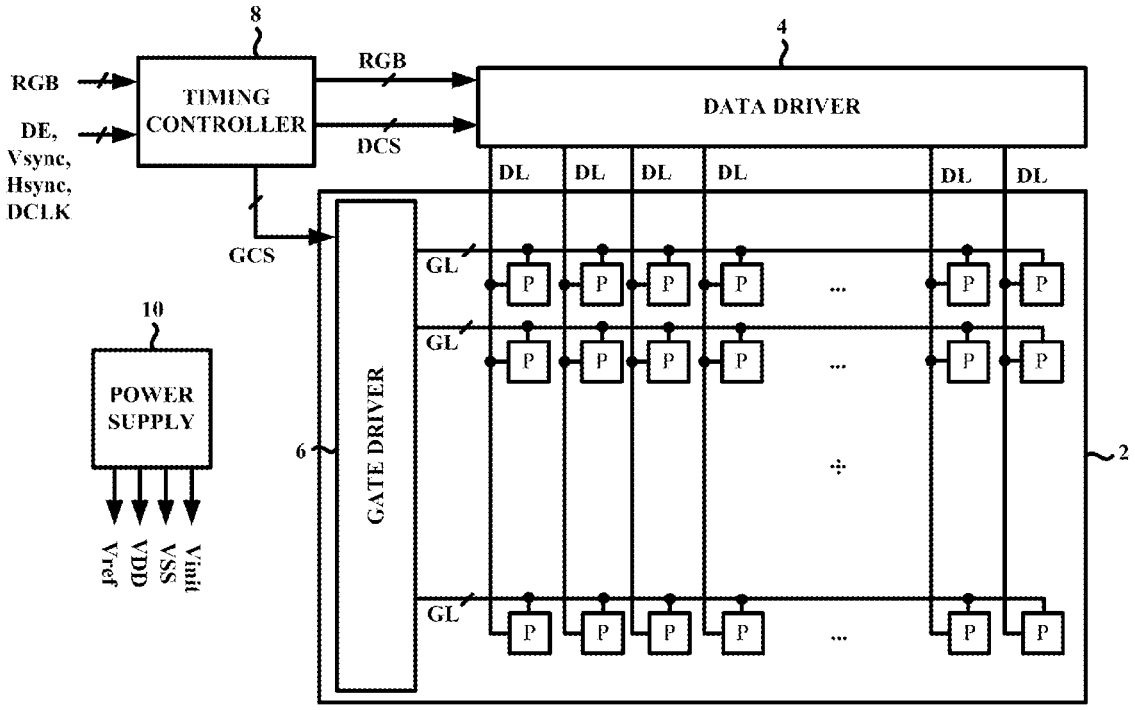
FIG. 1 is a block diagram illustrating a light emitting display device according to an embodiment of the present invention.

FIG. 1 is a block diagram illustrating a light emitting display device according to an embodiment of the present invention.

The light emitting display device shown in FIG. 1 includes a display panel 2, a data driver 4, a gate driver 6, a timing controller 8, and a power supply 10.

The display panel 2 includes a plurality of data lines DL, a plurality of gate lines GL intersecting with the data lines DL, and pixels P arranged in the form of a matrix. The plural gate lines GL include a plurality of scan lines (not shown), to which scan pulses are applied, a plurality of initialization control lines (not shown), to which initialization control signals are applied, a plurality of emission control lines (not shown), to which emission control signals are applied, and a plurality of sensing lines (not shown), to which sensing signals are applied.

The data driver 4 includes at least one source drive IC (not shown). The source drive IC receives digital video data RGB from the timing controller 8. In response to a data control signal DCS from the timing controller 8, the source drive IC also converts the digital video data RGB into a gamma-compensated voltage, thereby generating a data voltage. The data voltage from the data driver 4 is then supplied to the data lines DL of the display panel 2. The source drive IC may be connected to the data lines DL of the display panel 2, using a chip-on-glass (COG) process or a tape automated bonding (TAB) process.

The gate driver 6 outputs a plurality of gate signals in response to a gate control signal GCS from the timing controller 8. The plural gate signals include a plurality of scan pulses SC, a plurality of initialization control signals INT, a plurality of emission control signals EM, and a plurality of sensing signals SS. The gate driver 6 sequentially outputs the above-described plural gate signals to the gate lines GL from the first gate line GL to the last gate line GL. The gate driver 6 may be directly formed on a lower substrate of the display panel 2 or may be connected between the gate lines GL of the display panel 2 and the timing controller 8, using a TAB method.

The timing controller 8 receives digital video data RGB from an external host computer via a low voltage differential signaling (LVDS) interface, a transition minimized differential signaling (TMDS) interface or the like. The timing controller 8 transmits the digital video data RGB input from the host computer to the source drive IC. Also, the timing controller 8 receives timing signals such as a vertical synchronization signal Vsync, a horizontal synchronization signal Hsync, a data enable signal DE, and a dot clock DCLK from the host computer via an LVDS or TMDS interface receiver circuit. The timing controller 2 generates timing control signals DCS and GCS for controlling operation timings of the data driver 4 and gate driver 6, respectively, on the basis of the timing signals from the host computer.

The power supply 10 generates a gamma voltage, a first driving voltage VDD, a second driving voltage VSS, a reference voltage Vref, and an initialization voltage Vinit, which are used to drive the pixels P. The voltages are set such that the initialization voltage Vinit is lower than the reference voltage Vref, the reference voltage Vref is lower than the second driving voltage VSS, and the second driving voltage VSS is lower than the first driving voltage VDD. For example, the first driving voltage VDD may be a constant voltage of about 10V or more, the second driving voltage VSS may be a constant voltage of 0V, the reference voltage Vref may be a constant voltage ranging from about −2V to 0V, and the initialization voltage Vinit may be a constant voltage ranging from about −7V to −6V. The first driving voltage VDD is determined, taking into consideration the threshold voltage Vth of organic light emitting diodes OLED used in the pixels. In other words, the first driving voltage VDD may be varied in accordance with the threshold voltage of the organic light emitting diodes OLED.

Hereinafter, the circuit configuration of each pixel P will be described in detail in conjunction with various embodiments of the present invention.

First Embodiment (6T3C)

Figure 2:
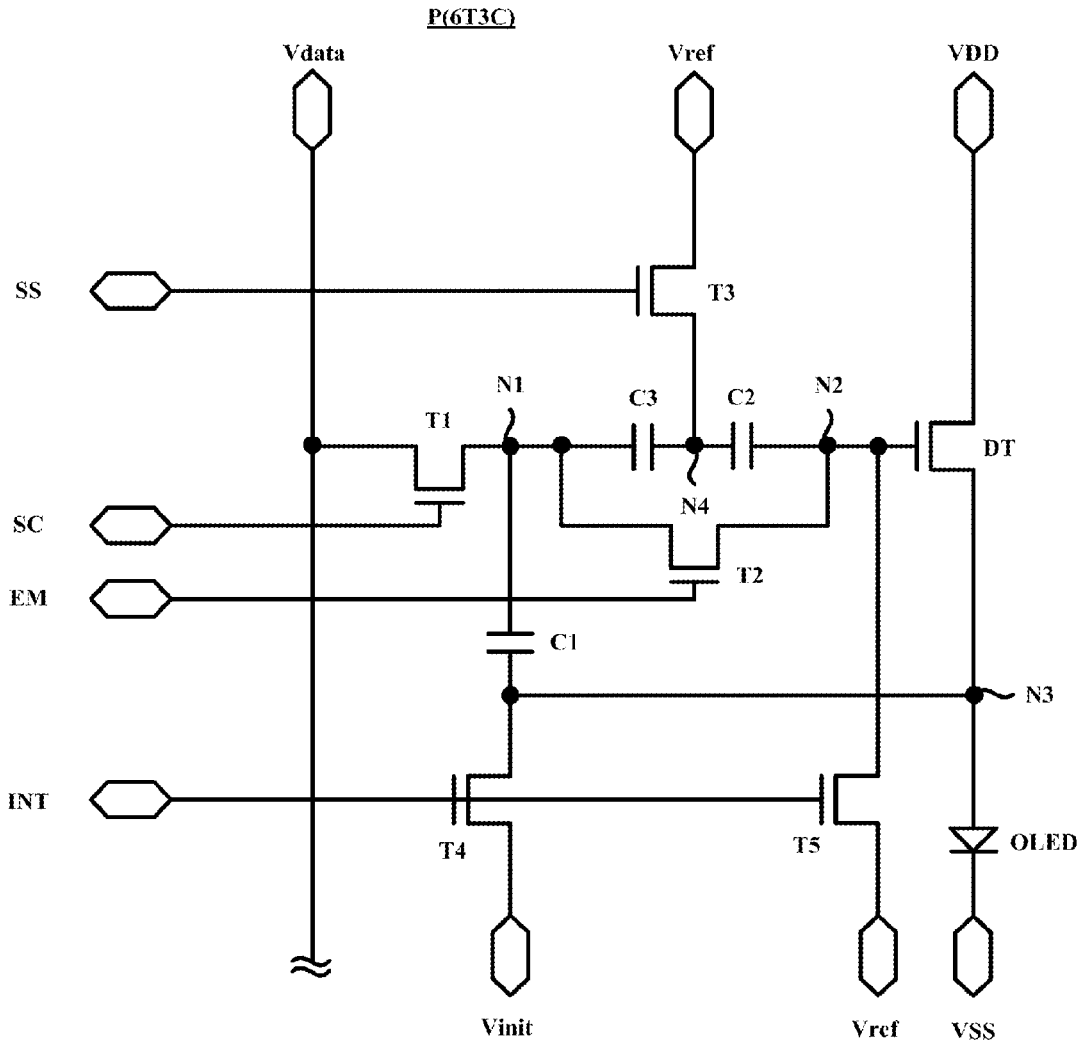
FIG. 2 is a circuit diagram of an example of a pixel according to a first embodiment of the present invention.
Figure 3:
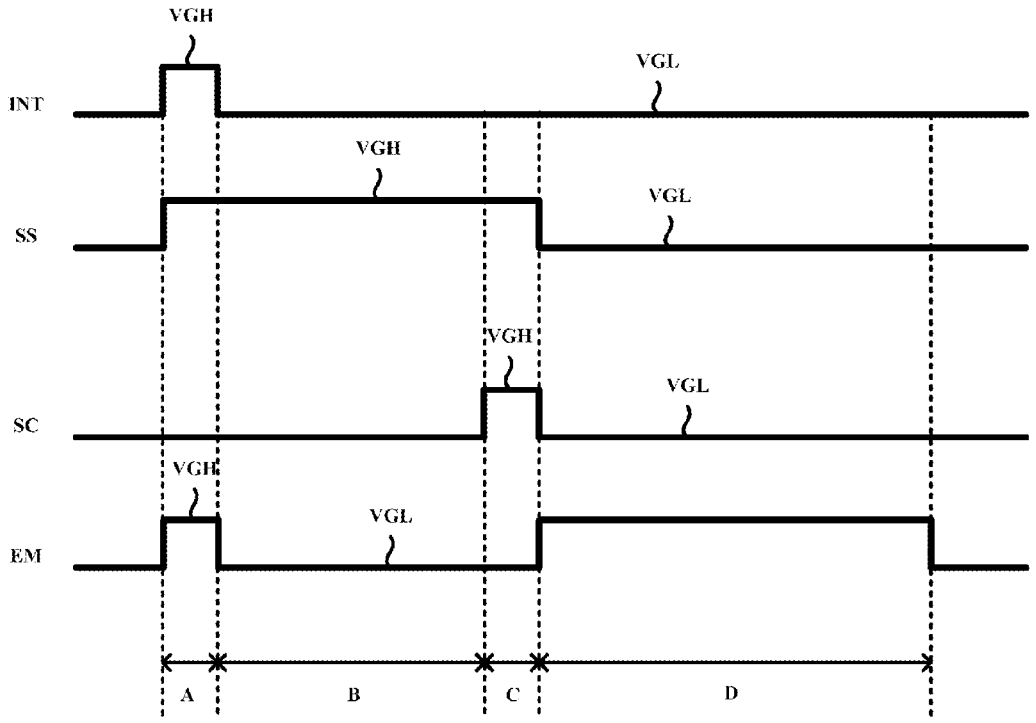
FIG. 3 is a driving waveform diagram illustrating operation of the pixel shown in FIG. 2.

FIG. 2 is a circuit diagram of a pixel according to a first embodiment of the present invention. FIG. 2 illustrates a circuit configuration of one of the pixels P shown in FIG. 1. FIG. 3 is a driving waveform diagram illustrating operation of the pixel P shown in FIG. 2.

The pixel P shown in FIG. 2 has a 6T3C structure including 6 TFTs and 3 capacitors. That is, the pixel P of FIG. 2 includes a driving TFT DT, first to fifth TFTs T1 to T5, first to third capacitors C1 to C3, and a organic light emitting diode OLED.

The first TFT T1 supplies, to a first node N1, a data voltage Vdata supplied from the data line DL corresponding to the pixel P in response to a scan signal SC supplied from the scan line corresponding to the pixel P.

The second TFT T2 forms a current path between the first node N1 and a second node N2 in response to an emission control signal EM supplied from the emission control line corresponding to the pixel P.

The driving TFT DT forms a current path between a supply line for the first driving voltage VDD and a third node N3 in accordance with a voltage level of the second node N2.

The third TFT T3 supplies the reference voltage Vref to a fourth node N4 in response to the sensing signal SS supplied from the sensing line corresponding to the pixel P.

The fourth TFT T4 supplies the initialization voltage Vinit to the third node N3 in response to the initialization control signal INT supplied from the initialization control line corresponding to the pixel P.

The fifth TFT T5 supplies the reference voltage Vref to the second node N2 in response to the initialization control signal INT.

The first capacitor C1 is connected between the first node N1 and the third node N3.

The second capacitor C2 is connected between the second node N2 and the fourth node N4.

The third capacitor C3 is connected between the first node N1 and the fourth node N4.

The organic light emitting diode OLED is connected between the third node N3 and the supply line for the second driving voltage VSS. That is, the organic light emitting diode OLED is connected, at an anode electrode thereof, to the third node N3 while being connected, at a cathode electrode thereof, to the supply line for the second driving voltage VSS.

Meanwhile, each of the scan signal SC, initialization control signal INT, emission control signal EM, and sensing signal SS supplied to the pixel P is a pulse signal having a gate-on voltage (VGH) level or a gate-off voltage (VGL) level. These signals are driven in a separate manner in first to fourth periods A, B, C, and D. This will be described in detail with reference to FIG. 3.

The initialization control signal INT has a gate-on voltage (VGH) level in the first period A while having a gate-off voltage (VGL) level in the second to fourth periods B, C, and D.

The sensing signal SS has a gate-on voltage (VGH) level in the first to third periods A, B, and C while having a gate-off voltage (VGL) level in the fourth period D.

The scan signal SC has a gate-on voltage (VGH) level in the third period C while having a gate-off voltage (VGL) level in the first, second and fourth periods A, B, and D.

The emission control signal EM has a gate-on voltage (VGH) level in the first and fourth periods A and D while having a gate-off voltage (VGL) level in the second and third periods B and C.

Hereinafter, operation of the pixel P according to the first embodiment of the present invention will be described in detail in conjunction with each period with reference to FIGS. 2 and 3.

First Period (A; First Embodiment)

The first period A is an initialization period. In the first period A, the initialization control signal INT, sensing signal SS, and emission control signal EM are output in a state of having a gate-on voltage (VGH) level, whereas the scan signal SC is output in a state of having a gate-off voltage (VGL) level. In the first period A, accordingly, the second to fifth TFTs T2 to T5 are turned on, whereas the first TFT T1 is turned off.

Then, the reference voltage Vref is supplied to the second node N2 via the turned-on fifth TFT T5. The reference voltage Vref is also supplied to the first node N1 via the turned-on second TFT T2. Also, the reference voltage Vref is supplied to the fourth node N4 via the turned-on third TFT T3. Accordingly, the first, second and fourth nodes N1, N2 and N4 are initialized to the reference voltage Vref.

Meanwhile, the initialization voltage Vinit is supplied to the third node N3 via the turned-on fourth TFT T4. In this case, the level of the initialization voltage Vinit applied to the third node N3 is determined by an internal resistance of the driving TFT DT and an internal resistance of the fourth TFT T4. That is, the voltage of the third node N3 is varied in accordance with the threshold voltage Vth of the driving TFT DT. In the first period A, accordingly, the voltage of the third node N3 is saturated to assist compensation of the threshold voltage Vth. Also, since the initialization voltage Vinit is lower than the second driving voltage VSS, and is lower than the threshold voltage of the organic light emitting diode OLED, the organic light emitting diode OLED is reverse biased. As a result, the organic light emitting diode OLED is maintained in an OFF state.

Also, in the first period A, the second node N2, to which the gate electrode of the driving TFT DT is connected, is maintained at the level of the reference voltage Vref. The third node N3, to which the source electrode of the driving TFT DT is connected, is maintained at the level of the initialization voltage Vinit. The drain electrode of the driving TFT DT is maintained at the level of the first driving voltage VDD. As a result, the driving TFT DT is initialized. In this state, the driving TFT DT is turned on because the voltage difference between the gate and source electrodes of the driving TFT DT exceeds the threshold voltage Vth. Accordingly, initialization current flows through the turned-on driving TFT DT. However, since the organic light emitting diode OLED is reverse biased, as described, the initialization current is sunk to the initialization line, which supplies the initialization voltage Vinit, without flowing to the organic light emitting diode OLED.

Thus, in the first period A, initialization current flows from the supply line for the first driving voltage VDD to the initialization line via the driving TFT DT. Accordingly, the driving TFT DT is initialized irrespective of the polarity of the threshold voltage Vth. That is, the driving TFT DT is initialized by the above-described initialization current even when the threshold voltage Vth of the driving TFT DT is lower than "0" in the case in which the driving TFT DT has an N type conductivity or even when the threshold voltage Vth of the driving TFT DT is higher than "0" in the case in which the driving TFT DT has a P type conductivity. As a result, the performance of detecting the threshold voltage Vth of the driving TFT DT after the first period A is enhanced.

In brief, in the first period A, the organic light emitting diode OLED is maintained in an OFF state, and the first, second and fourth nodes N1, N2 and N4 are initialized to the level of the reference voltage Vref. Also, the driving TFT DT is initialized irrespective of the polarity thereof. In particular, in the first period A, the third node N3 is discharged to the level of the initialization voltage Vinit, which has a low voltage level. Accordingly, it is possible to prevent the voltage of the third node N3 from increasing even when the driving TFT DT is turned on. As a result, the detection and compensation range of the threshold voltage Vth of the driving TFT DT is widened.

Second Period (B; First Embodiment)

The second period B is a Vth sensing period. In the second period B, the sensing signal SS is output in a state of having a gate-on voltage (VGH) level, whereas the initialization control signal INT, scan signal SC, and emission control signal EM are output in a state of having a gate-off voltage (VGL) level. In the second period B, accordingly, the third TFT T3 is turned on, whereas the first, second, fourth and fifth TFTs T1, T2, T4 and T5 are turned off Then, the voltage of the third node N3 is varied toward the voltage of the second node N2. Accordingly, the threshold voltage Vth of the driving TFT DT is detected in a source follower manner. In this case, the varied voltage of the second node N2 is fixed by the second capacitor C2 because the reference voltage Vref is supplied to the fourth node N4 via the turned-on third TFT T3. Meanwhile, the voltage of the second node N2 is determined in accordance with the ratio between the capacitance of the second capacitor C2 and the gate-source overlap capacitance of the driving TFT DT and the threshold voltage Vth of the driving TFT DT. That is, if the threshold voltages Th of the driving TFTs DT in two different pixels P are different, the voltage variations of the second nodes N2 in the two pixels P are also different.

On the other hand, the voltage of the third node N3 is increased from the level of the initialization voltage Vinit to a voltage level of [(Vref−Vth)+α]. That is, it can be seen that, in the second period B, the threshold voltage Vth of the driving TFT DT is stored at the third node N3 in an amplified state. Here, "α" represents an amplification compensation value. When the threshold voltage Vth of the driving TFT DT increases, the amplification compensation value is also increased.

The reason why the threshold voltage Vth of the driving TFT DT is stored in an amplified state in the second period B is as follows. In the fourth period D following the second period B, the data voltage, which has been compensated for the threshold voltage Vth of the driving TFT DT, is transferred from the first node N1 to the second node N2. In this case, a loss is brought on the compensated data voltage during transfer thereof due to a parasitic capacitance between the first node N1 and the second node N2. In order to compensate for the loss, the threshold voltage Vth of the driving TFT DT is stored in an amplified state in the second period B in the first embodiment.

Third Period (C; First Embodiment)

The third period C is a data writing period. In the third period C, the sensing signal SS and scan signal SC are output in a state of having a gate-on voltage (VGH) level, whereas the initialization control signal INT and emission control signal EM are output in a state of having a gate-off voltage (VGL) level. In the third period C, accordingly, the first and third TFTs T1 and T3 are turned on, whereas the second, fourth and fifth TFTs T2, T4 and T5 are turned off.

Then, the data voltage Vdata is supplied to the first node N1 via the turned-on first TFT T1, and is stored in the first capacitor C1.

Meanwhile, when the voltage of the first node N1 varies in the third period C, the voltage of the second node N2 is varied due to a coupling phenomenon occurring at the third capacitor C3 and second capacitor C2. As a result, a voltage variation occurs at the third node N3. In this case, a compensation loss may be brought on the threshold voltage Vth of the driving TFT DT. In order to avoid such a phenomenon, in the first embodiment, the third TFT T3 is turned on in the third period C, to apply the reference voltage Vref to the fourth node N4. Accordingly, it is possible to avoid voltage variations of the second and third nodes N2 and N3 even when the voltage of the first node N1 varies in the third period C, because the fourth node N4 is fixed to the reference voltage Vref.

Fourth Period (D; First Embodiment)

The fourth period D is a light emission period. In the fourth period D, the emission control signal EM is output in a state of having a gate-on voltage (VGH) level, whereas the initialization control signal INT, sensing signal SS and scan signal SC are output in a state of having a gate-off voltage (VGL) level. In the fourth period D, accordingly, the second TFT T2 is turned on, whereas the first, third, fourth and fifth TFTs T1, T3, T4 and T5 are turned off.

Then, the data voltage Vdata of the first node N1 is supplied to the second node N2 via the turned-on second TFT T2. As a result, the driving TFT DT is turned on by the voltage difference between the voltage difference between the gate and source electrodes of the driving TFT DT, namely, Vgs, that is, the voltage difference between the second node N2 and the third node N3. At this time, the Vth stored in the third node N3 is transferred to the second node N2. Accordingly, the driving TFT DT is driven by the Vgs that the Vth is compensated for. That is, the driving TFT DT is turned on by the data voltage Vdata applied to the second node N2, thereby supplying the driving current to the organic light emitting diode OLED which, in turn, emits light.

Figure 4:
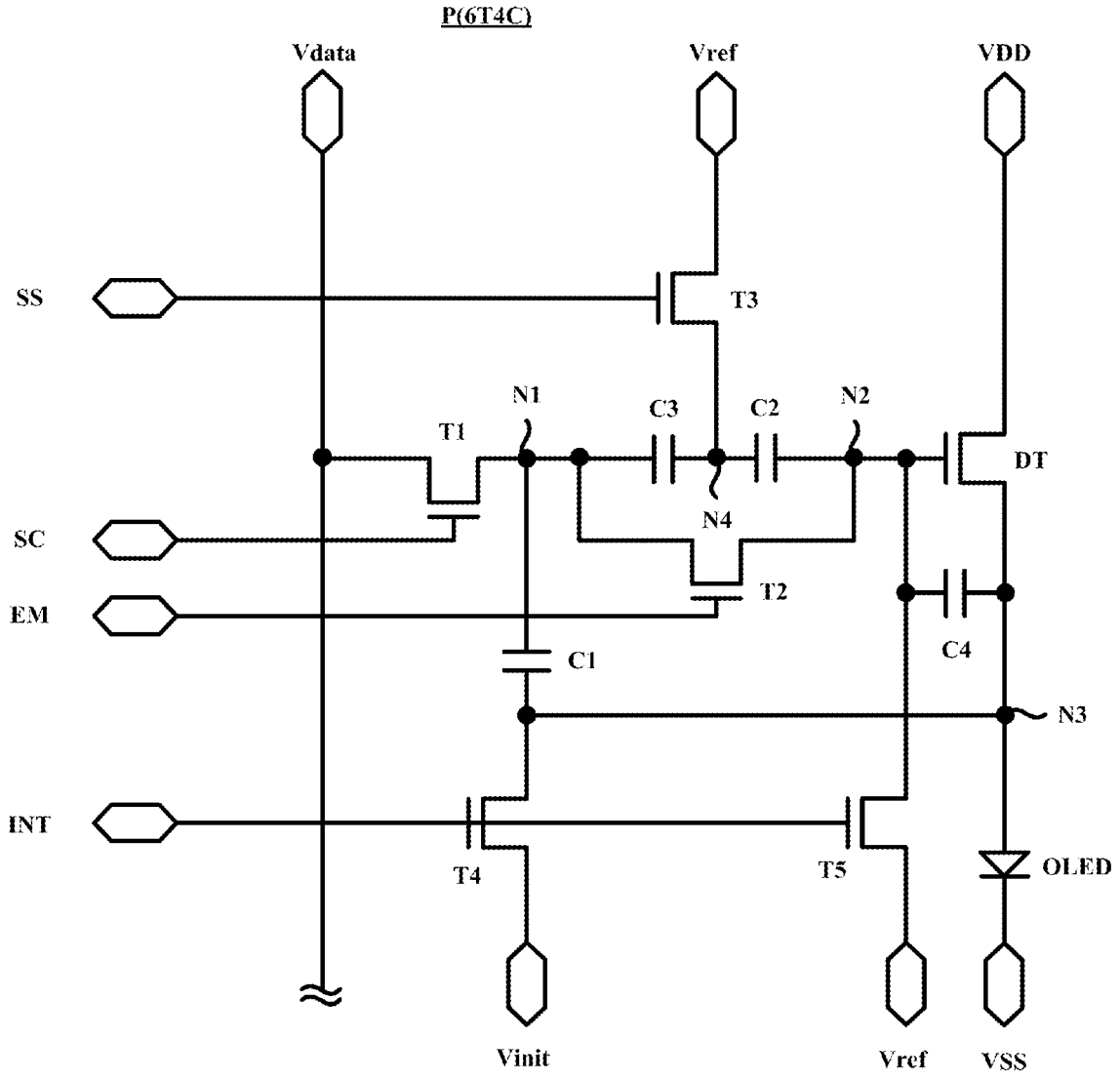
FIG. 4 is a circuit diagram of another example of the pixel according to the first embodiment of the present invention.

Meanwhile, when the second TFT T2 is turned off after supply of the data voltage Vdata to the second node N2, the voltage of the second node N2 is held by virtue of the the first to third capacitors C1 to C3 connected in series. Accordingly, the light emission of the organic light emitting diode OLED is continued. Meanwhile, each pixel P according to the first embodiment may further include a fourth capacitor C4 connected between the second node N2 and the third node N3, as shown in FIG. 4. In this case, the fourth capacitor C4 is connected to the first to third capacitors C1 to C3 in parallel in the fourth period D. Accordingly, the fourth capacitor C4 functions to hold the voltage of the second node N2.

Second Embodiment (7T2C)

Figure 5:
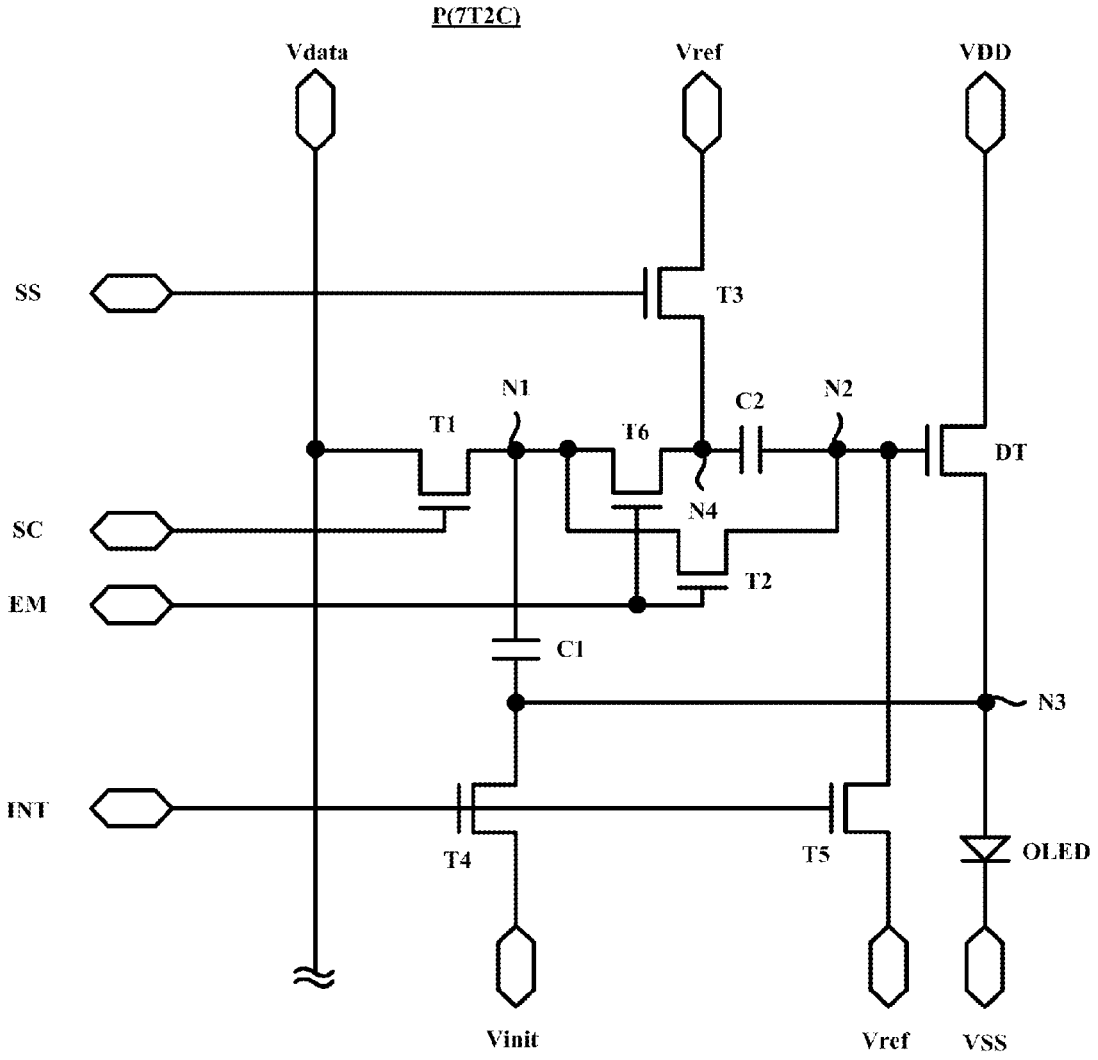
FIG. 5 is a circuit diagram of a pixel according to a second embodiment of the present invention.

FIG. 5 is a circuit diagram of a pixel according to a second embodiment of the present invention. FIG. 5 illustrates a circuit configuration of one of the pixels P shown in FIG. 1. Gate signals applied to the pixel P shown in FIG. 1 have the same driving timings as those of the first embodiment. That is, the driving waveform diagram of FIG. 3 may be referred to operation of the pixel P shown in FIG. 5.

The pixel P shown in FIG. 5 has a 7T2C structure including 7 TFTs and 2 capacitors. That is, the pixel P of FIG. 5 includes a driving TFT DT, first to sixth TFTs T1 to T6, first and second capacitors C1 and C2, and a organic light emitting diode OLED.

The second embodiment has the same configuration as the first embodiment, except that the third capacitor C3 in the first embodiment is dispensed with, and the sixth TFT T6 is additionally provided. In this regard, one may refer to the descriptions of the first embodiment for descriptions of the first to fifth TFTs T1 to T5 and the first and second capacitors C1 and C2, and organic light emitting diode OLED. Accordingly, only the sixth TFT T6 will be described in conjunction with the second embodiment.

The sixth TFT T6 forms a current path between the first node N1 and the second node N2 in response to the emission control signal EM from the light emission signal EM supplied from the corresponding emission control line.

Hereinafter, operation of the pixel P according to the second embodiment of the present invention will be described in detail in conjunction with each period with reference to FIGS. 3 and 5.

First Period (A; Second Embodiment)

The first period A is an initialization period. In the first period A, the initialization control signal INT, sensing signal SS, and emission control signal EM are output in a state of having a gate-on voltage (VGH) level, whereas the scan signal SC is output in a state of having a gate-off voltage (VGL) level. In the first period A, accordingly, the second to sixth TFTs T2 to T6 are turned on, whereas the first TFT T1 is turned off.

Then, the reference voltage Vref is supplied to the second node N2 via the turned-on fifth TFT T5. The reference voltage Vref is also supplied to the first node N1 via the turned-on second TFT T2. Also, the reference voltage Vref is supplied to the fourth node N4 via the turned-on third TFT T3, and is supplied to the first node N1 via the turned-on sixth TFT T6. Accordingly, the first, second and fourth nodes N1, N2 and N4 are initialized to the reference voltage Vref.

Meanwhile, the initialization voltage Vinit is supplied to the third node N3 via the turned-on fourth TFT T4. In this case, the level of the initialization voltage Vinit applied to the third node N3 is determined by an internal resistance of the driving TFT DT and an internal resistance of the fourth TFT T4. That is, the voltage of the third node N3 is varied in accordance with the threshold voltage Vth of the driving TFT DT. In the first period A, accordingly, the voltage of the third node N3 is saturated to assist compensation of the threshold voltage Vth. Also, since the initialization voltage Vinit is lower than the second driving voltage VSS, and is lower than the threshold voltage of the organic light emitting diode OLED, the organic light emitting diode OLED is reverse biased. As a result, the organic light emitting diode OLED is maintained in an OFF state.

Also, in the first period A, the second node N2, to which the gate electrode of the driving TFT DT is connected, is maintained at the level of the reference voltage Vref. The third node N3, to which the source electrode of the driving TFT DT is connected, is maintained at the level of the initialization voltage Vinit. The drain electrode of the driving TFT DT is maintained at the level of the first driving voltage VDD. As a result, the driving TFT DT is initialized. In this state, the driving TFT DT is turned on because the voltage difference between the gate and source electrodes of the driving TFT DT exceeds the threshold voltage Vth. Accordingly, initialization current flows through the turned-on driving TFT DT. However, since the organic light emitting diode OLED is backwardly biased, as described, the initialization current is sunk to the initialization line, which supplies the initialization voltage Vinit, without flowing to the organic light emitting diode OLED.

Thus, in the first period A, initialization current flows from the supply line for the first driving voltage VDD to the initialization line via the driving TFT DT. Accordingly, the driving TFT DT is initialized irrespective of the polarity of the threshold voltage Vth. That is, the driving TFT DT is initialized by the above-described initialization current even when the threshold voltage Vth of the driving TFT DT is lower than "0" in the case in which the driving TFT DT has an N type conductivity or even when the threshold voltage Vth of the driving TFT DT is higher than "0" in the case in which the driving TFT DT has a P type conductivity. As a result, the performance of detecting the threshold voltage Vth of the driving TFT DT after the first period A is enhanced.

In brief, in the first period A, the organic light emitting diode OLED is maintained in an OFF state, and the first, second and fourth nodes N1, N2 and N4 are initialized to the level of the reference voltage Vref. Also, the driving TFT DT is initialized irrespective of the polarity thereof. In particular, in the first period A, the third node N3 is discharged to the level of the initialization voltage Vinit, which has a low voltage level. Accordingly, it is possible to prevent the voltage of the third node N3 from increasing even when the driving TFT DT is turned on. As a result, the detection and compensation range of the threshold voltage Vth of the driving TFT DT is widened.

Second Period B Second Embodiment)

The second period B is a Vth sensing period. In the second period B, the sensing signal SS is output in a state of having a gate-on voltage (VGH) level, whereas the initialization control signal INT, scan signal SC, and emission control signal EM are output in a state of having a gate-off voltage (VGL) level. In the second period B, accordingly, the third TFT T3 is turned on, whereas the first, second, fourth, fifth and sixth TFTs T1, T2, T4, T5 and T6 are turned off.

The operation of the pixel P in the second period B in the second embodiment is the same as that of the first embodiment and, as such, description thereof may refer to that of the first embodiment.

Third Period (C; Second Embodiment)

The third period C is a data writing period. In the third period C, the sensing signal SS and scan signal SC are output in a state of having a gate-on voltage (VGH) level, whereas the initialization control signal INT and emission control signal EM are output in a state of having a gate-off voltage (VGL) level. In the third period C, accordingly, the first and third TFTs T1 and T3 are turned on, whereas the second, fourth, fifth and sixth TFTs T2, T4, T5 and T6 are turned off.

Then, the data voltage Vdata is supplied to the first node N1 via the turned-on first TFT T1, and is stored in the first capacitor C1.

Meanwhile, when the voltage of the first node N1 varies in the third period C, the voltage of the second node N2 is varied due to a coupling phenomenon occurring at the second capacitor C2. As a result, a voltage variation occurs at the third node N3. In this case, a compensation loss may be brought onto the threshold voltage Vth of the driving TFT DT. In order to avoid such a phenomenon, in the second embodiment, the third TFT T3 is turned on in the third period C, to apply the reference voltage Vref to the fourth node N4. Accordingly, it is possible to avoid voltage variations of the second and third nodes N2 and N3 even when the voltage of the first node N1 varies in the third period C, because the fourth node N4 is fixed to the reference voltage Vref.

Fourth Period (D; Second Embodiment)

The fourth period D is a light emission period. In the fourth period D, the emission control signal EM is output in a state of having a gate-on voltage (VGH) level, whereas the initialization control signal INT, sensing signal SS and scan signal SC are output in a state of having a gate-off voltage (VGL) level. In the fourth period D, accordingly, the second and sixth TFTs T2 and T6 are turned on, whereas the first, third, fourth and fifth TFTs T1, T3, T4 and T5 are turned off.

The operation of the pixel P in the fourth period D in the second embodiment is the same as that of the first embodiment and, as such, one may refer to the description of the first embodiment for a description of the second embodiment.

Figure 6:
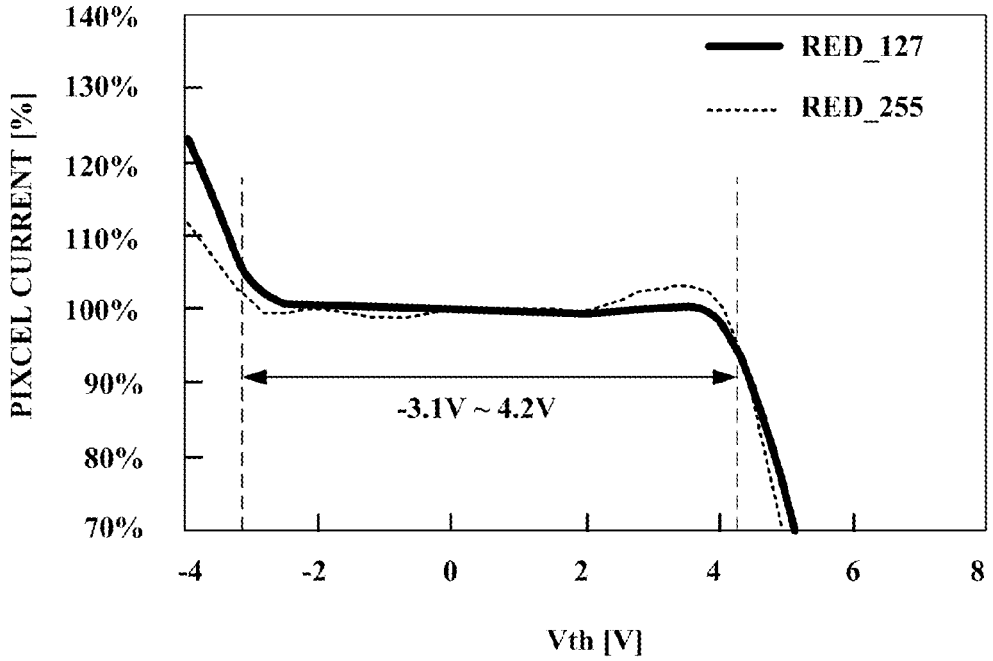
FIG. 6 is a graph explaining variations of threshold voltage compensation capabilities at different grayscales in accordance with variations of threshold voltage of all thin film transistors (TFTs) included in the pixel shown in FIG. 2.

FIG. 6 is a graph explaining variations of threshold voltage compensation capabilities at different grayscales in accordance with variations of threshold voltage of all TFTs included in the pixel P shown in FIG. 2. In FIG. 6, the X-axis represents a threshold voltage Vth, and the Y-axis represents a normalized current variation of the organic light emitting diode OLED.

Referring to FIG. 6, it can be seen that, when the current variation of the organic light emitting diode OLED is 95% to 105% (±5%), the current variation at each grayscale is substantially constant, even though the threshold voltage of each TFT is shifted within a wide range of −3.1V to 4.2V.

Figure 7:
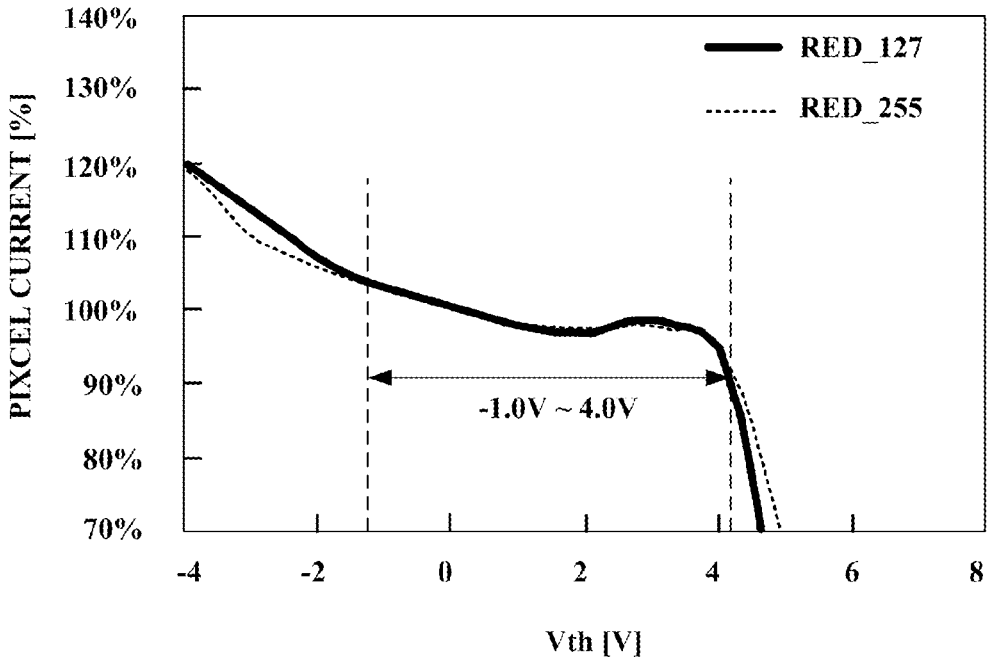
FIG. 7 is a graph explaining variations of threshold voltage compensation capabilities at different grayscales in accordance with a variation of the threshold voltage of a driving TFT included in the pixel shown in FIG. 2.

FIG. 7 is a graph explaining variations of threshold voltage compensation capabilities at different grayscales in accordance with a variation of the threshold voltage of the driving TFT DT included in the pixel P shown in FIG. 2. In FIG. 7, the X-axis represents the threshold voltage Vth of the driving TFT DT, and the Y-axis represents a normalized current variation of the organic light emitting diode OLED.

Referring to FIG. 7, it can be seen that, when the current variation of the organic light emitting diode OLED is 95% to 105% (±5%), the current variation at each grayscale is substantially constant, even though the threshold voltage of the driving TFT is shifted within a wide range of −1.0V to 4.0V.

The light emitting display device according to the present invention has the following technical benefits.

First, each pixel of the light emitting display device has a structure in which the number of parasitic capacitors of TFTs among the first to fourth nodes is reduced. As a result, the amount of charges lost by the parasitic capacitors is reduced. Accordingly, the threshold voltage compensation period is increased and, as such, it is possible to achieve an increase in threshold voltage compensation rate and an increase in threshold voltage compensation range.

Second, each pixel of the light emitting display device has a structure in which current generated by the first driving voltage in the first period (initialization period) is sunk from the driving TFT to the initialization voltage source. Accordingly, a superior threshold voltage compensation capability is obtained even when the threshold voltage of the driving TFT is lower than "0" or higher than "0".

Third, each pixel of the light emitting display device is a normally-off compensation structure in which all TFTs are turned off when the turned-on second TFT is turned off in the fourth period (emission period). Accordingly, the reliability of the first TFT T1 can be enhanced.

Fourth, the first to third nodes are simultaneously initialized to a constant voltage in the first period. Accordingly, it is possible to eliminate problems associated with initialization timings of the nodes. Thus, the pixel structure of the present invention is suitable for mass production.

Fifth, even when the voltage of the first node varies during writing of the data voltage in the third period, it is possible to prevent the voltages of the second and third nodes from varying because the voltage of the fourth node is fixed to the reference voltage. Accordingly, it is possible to obtain a superior threshold voltage compensation capability even when the TFTs exhibit high mobility.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A light emitting display device comprising:

a plurality of pixels arranged in the form of a matrix, to display an image, wherein each of the pixels comprises:

a first switching element for supplying, to a first node, a data voltage supplied from a data line in response to a scan signal supplied from a scan line;

a second switching element for forming a current path between the first node and a second node in response to an emission control signal supplied from an emission control line;

a driving switching element for forming a current path between a first supply line for a first driving voltage and a third node in accordance with a voltage level of the second node;

a third switching element for supplying a reference voltage to a fourth node in response to a sensing signal supplied from a sensing line;

a fourth switching element for supplying an initialization voltage supplied from an initialization line to the third node in response to an initialization control signal supplied from an initialization control line;

a fifth switching element for supplying the reference voltage to the second node in response to the initialization control signal;

a first capacitor connected between the first node and the third node;

a second capacitor connected between the second node and the fourth node;

either passive elements or active elements connected between the first node and the fourth node, wherein the passive or active elements include capacitors or transistors; and an organic light emitting diode connected between the third node and a second supply line for a second driving voltage;

wherein the first capacitor, the second capacitor, the either passive elements or active elements are coupled in series between the second and third nodes, the second node as a gate of the driving switching element and the third node as a connection node between the driving switching element and the organic light emitting diode, and wherein the second switching element is coupled with the series connection of the second capacitor and the either passive elements or active elements in parallel between the first and second nodes, the second switching element supplying the data voltage from the first node to the second node.

2. The light emitting display device according to claim 1, wherein:

the initialization voltage is lower than the reference voltage;

the reference voltage is lower than the second driving voltage; and the second driving voltage is lower than the first driving voltage.

3. The light emitting display device according to claim 2, wherein:

in a first period, the first, second and fourth nodes are initialized to the reference voltage by the second, third and fifth switching elements, the third node is initialized to the initialization voltage by the fourth switching element, and current of the driving switching element is initialized;

in a second period, the third switching element supplies the reference voltage to the fourth node and a threshold voltage of the driving switching element is amplified and stored in the third node;

in a third period, the data voltage is supplied to the first node by the first switching element to be stored in the first capacitor and the third switching element supplies the reference voltage to the fourth node;

in a fourth period, the data voltage stored in the first capacitor is transferred to the second node by the second switching element and the driving switching element supplies the current corresponding to the data voltage to the organic light emitting diode via the third node.

4. The light emitting display device according to claim 3, wherein in the first period, the initialized current of the driving switching element flows to the initialization line via the fourth switching element, without flowing to the organic light emitting diode.

5. The light emitting display device according to claim 3, wherein:

in the first period, the initialization control signal, the sensing signal, and the emission control signal have a gate-on voltage;

in the second period, the sensing signal has the gate-on voltage;

in the third period, the sensing signal and the scan signal have the gate-on voltage; and in the fourth period, the emission control signal has the gate-on voltage.

6. The light emitting display device according to claim 3, wherein the passive element is a third capacitor connected between the first node and the fourth node.

7. The light emitting display device according to claim 6, wherein:

the second switching element is turned-off or turned-on in a period after the fourth period; and when the second switching element is turned-off in the period after the fourth period, the voltage of the second node is held by the first to third capacitors connected to the second node in series to maintain light emission of the organic light emitting diode.

8. The light emitting display device according to claim 7, wherein each of the pixels further comprises:

a fourth capacitor connected between the second node and the third node.

9. The light emitting display device according to claim 8, wherein when the second switching element is turned-off in the period after the fourth period, the voltage of the second node is held by the first to third capacitors connected to the second node in series and the fourth capacitor connected to the second node in parallel to maintain light emission of the organic light emitting diode.

10. The light emitting display device according to claim 3, wherein the active element is a sixth switching element forming a current path between the first node and the fourth node in response to the emission control signal.

11. The light emitting display device according to claim 10, wherein the second and sixth switching elements maintain the turned-on state during the fourth period.

12. The light emitting display device according to claim 1, wherein each of the switching elements and the driving switching element is a P-type or N-type switching element.

* * * * *